US005104275A

United States Patent [19]

Rathert

[11] Patent Number: 5,104,275

[45] Date of Patent: Apr. 14, 1992

[54] METHOD OF AND APPARATUS FOR BACKING BOOK BLOCKS

[75] Inventor: Horst Rathert, Minden, Fed. Rep. of Germany

[73] Assignee: Kolbus GmbH & Co. KG, Rahden, Fed. Rep. of Germany

[21] Appl. No.: 658,758

[22] Filed: Feb. 21, 1991

[30] Foreign Application Priority Data

Feb. 26, 1990 [DE] Fed. Rep. of Germany ..... 4005949

[51] Int. Cl.[5] ..... B42C 5/02

[52] U.S. Cl. ..... 412/1; 412/30

[58] Field of Search ..... 412/1, 4, 5, 6, 7, 8, 412/9, 19, 30

[56] References Cited

U.S. PATENT DOCUMENTS 1,959,656 5/1934 Cahen .
2,455,971 12/1948 Bosch .
3,258,798 7/1966 Hawkes et al. .

FOREIGN PATENT DOCUMENTS 1439825 4/1963 France .
9356 3/1955 German Democratic Rep. .
1529734 10/1978 United Kingdom .

*Primary Examiner*—Timothy V. Eley
*Assistant Examiner*—Willmon J. Fridie
*Attorney, Agent, or Firm*—Chilton, Alix & Van Kirk

[57] ABSTRACT

In a method of backing book blocks, simultaneous backing operations are performed on the two halves of the block back by two backing elements which simultaneously execute a rolling movement on the block back in opposite directions starting from its center, so as to compress the printed sheets in its central region, and also execute a tangential sliding, rubbing movement on the book block back, so as to bend the printed sheets over in its side regions.

20 Claims, 4 Drawing Sheets

METHOD OF AND APPARATUS FOR BACKING BOOK BLOCKS

BACKGROUND OF THE INVENTION

1. Field of the Invention

The present invention relates to shaping the backs of book blocks, preparatory to the application of a cover thereto during the production of books, and particularly to forming the back of a book block which has previously been rounded such that the block assumes a shape which is appropriate to the binding to be applied thereto. More specifically, the present invention is directed to apparatus for controllably applying shaping forces to a book block back and especially to apparatus for providing a joint fold in a book block adjacent a rounded back thereof. Accordingly, the general objects of the present invention are to provide novel and improved methods and apparatus of such character.

2. Description of the Prior Art

This invention relates to an operation, performed during the manufacture of books, known in the trade as "backing". The preparation of a book block for receiving a cover is performed by rounding and backing apparatus which serially act on the block. The backing apparatus of the prior art include a shaped part, known as a backing bar, which moves backwards and forwards over the entire breadth of the book block back. As a result of this reciprocating movement, which is accompanied by the application of pressure and thus the generation of frictional forces, the outer edge regions of the folded printed sheets which comprise the book block are turned away from the center of the book block and are bent over towards the sides of the book block at angles which progressively increase from the block center towards the sides. The backing method and apparatus thus results in the book block receiving a generally mushroom-like back shape. It is necessary that the thus shaped book block back be stable, i.e., the printed sheets must be treated such that they will retain the desired shape which has been imparted thereto by the backing apparatus.

A book rounding and backing machine with a reciprocating shaped part which acts on the book block back, this machine being exemplary of the prior art, is shown and described in German Patent 1,536,507. Among other deficiencies, the apparatus disclosed in this German patent has limited operational speed due to the fact that the shaped part acts on the left and right sides of the book block alternatively.

At the conclusion of a backing operation a book block back should have a rounded shape with a multiplicity of radii. In order to impart this desired back shape to a book block, the shaped parts employed in the backing operation must be matched to the back radius desired for the print run in question. This requirement results in long machine set-up times, especially in high-output book production units, due to the difficulty of gaining access to the shaped parts for the purpose of removal and reinstallation. Long set-up time is becoming increasingly intolerable, particularly in view of the fact that there is a tendency in the book-making industry for the number of copies produced per print run to be reduced. It is also to be noted that the changing of the shaped parts, particularly the rounding bars of prior art backing apparatus such as exemplified by German Patent 1,536,507, requires highly trained personnel and necessitates the maintenance of a substantial inventory of different size bars. Both of these requirements contribute to significantly increased production costs.

Even when employing the best available prior art apparatus, as a result of the powerful recovery forces exerted by some papers, "backed" book blocks sometimes fail to retain the shape imparted thereto by the backing apparatus. This failure to retain shape is usually characterized by "sagging" of the back, usually in its central region. Such "sagging" results in unacceptable product and thus also has a deleterious effect on the cost of production of a book.

SUMMARY OF THE INVENTION

The present invention overcomes the above briefly discussed and other deficiencies and disadvantages of the prior art and, in so doing, provides a novel and improved method and apparatus for backing book blocks. Practice of the present invention makes it possible to achieve a substantial increase in production and, simultaneously, significantly improved quality. The increase in production is, in part, achieved by the fact that the present invention eliminates the need to change the shaped parts which act on the book block back each time the book configuration is changed.

The present invention is practiced on book blocks which have previously been rounded and are being held in a clamped condition. In the practice of the invention, backing operations are performed on the two halves of a book block simultaneously by a pair of backing elements which are moved in opposite directions. These backing elements act on the book block with a defined pressing force and execute a rolling movement on the book block back, starting from its center, so as to compress the printed sheets comprising the block. The two backing elements also subject the book block back halves to oppositely directed, tangential, sliding movements as they simultaneously move outwardly from the central region thereof. The frictional forces resulting from the tangential sliding, rubbing movements produce tensile forces which bend the printed sheets over in the side regions of the block back.

As the backing elements execute their tangential sliding, rubbing movement they are subjected to a compensation action. This compensatory action is generally opposed to the tangential movement. The net result is a compound movement wherein the sliding, rubbing movement of the book blocks is balanced out at the central region of the book block and increases as the backing elements move outwardly.

Apparatus for practicing the above-described method, in accordance with a preferred embodiment of the invention, includes a pair of parallel backing bars which are movable in supporting frames, the movement of the backing bars relative to the supporting frames being along linear paths defined by appropriate guide means. The supporting frames, in turn, are capable of executing a swinging movement on a selected radius. The linear movement of the backing bars relative to the supporting frames and the swinging movement of the frames themselves are synchronized such that the backing bars move outwardly, relative to the book block center, on the radius while simultaneously moving inwardly in the supporting frames. In apparatus in accordance with the invention, once they have operated on the most outwardly disposed sheets of a book block, the backing bars will be returned to their initial position without contact with the book block.

The method and apparatus of the present invention enable the backing operation to be performed simultaneously on the two halves of the book block and thus, in comparison with the prior art, enable a doubling of the operating speed of the backing apparatus.

The composite movement of the backing elements in accordance with the invention, i.e., rolling movement and tangential rubbing movement on the rounded book block back, produces the compressive forces necessary for compressing the book block and the tensile forces necessary for bending the individual printed sheets outwardly during a single operation. The requisite tensile forces are exerted by each backing element acting solely in one direction. The combined forces, i.e., rolling and tangential sliding, makes it possible to achieve a stable, symmetrically compressed book back shape and, consequently, results in an improvement in the quality of the book block.

A particularly significant feature of the present invention is the ability to shift of the center of rotation of the backing elements in a manner dependent on rounding radius, book block thickness and joint fold angle. Thus, the present invention permits the achievement of infinitely fine matching of backing element movement to various back shapes while eliminating the need to change the backing elements. Elimination of the need to change the backing elements during each set-up procedure results in the present invention offering a very substantial decrease in set-up time when compared to the prior art.

BRIEF DESCRIPTION OF THE DRAWINGS

The present invention may be better understood, and its numerous objects and advantages will become to those skilled in the art, by reference to the accompanying drawings wherein like-reference numerals refer to like elements in the several figures and in which.

DESCRIPTION OF THE DISCLOSED EMBODIMENT

Figure 1A:
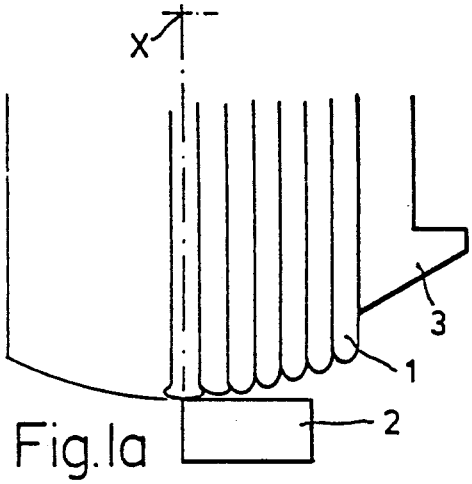
FIGS. 1*a*–1*e* diagrammatically show the movement sequence executed by a backing bar during practice of the invention.

With reference now to the drawings, and particularly FIGS. 1*a*–1*e*, the so-called backing of book blocks in accordance with the present invention is performed by two parallelly-oriented backing bars. A book block is indicated at 1 in the drawings while the backing bars are indicated at 2. Each backing bar acts on one-half of the back of a book block 1, which has previously been rounded, under a predefined pressure. During the time the backing bars act on the book block, the block is held between a pair of clamping jaws 3. The backing bars 2 execute a tangential sliding, rubbing movement in opposite directions starting from the center of book block back. This tangential sliding movement results in the generation of forces which cause the bending of the printed sheets which define the book block in the outer regions thereof as may best be seen from FIGS. 1*d* and 1*e*. The backing bars are also subjected to a compensating movement which, in effect, is counter to the direction of the tangential sliding, rubbing movement. As will be explained in greater detail below, as a result of the compensation, the backing bars initially apply only forces which cause compression at the center of the book block and subsequently subject the book block back to tangentially applied frictional forces, i.e., tensile forces, which produce the desired bending and which generally increase in magnitude in the outward direction.

In the interest of facilitating understanding of the invention, only one backing bar 2 is represented in the movement sequence diagrams of FIGS. 1*a*–1*e*. In FIG. 1 the backing bar moves about a center of rotation X. During the operational sequence represented by the progression from FIG. 1*a* to FIG. 1*b*, the tangential sliding movement of the backing bar which characterizes prior art backing operations, and thus the friction related tensile forces which would act on the printed sheets, is offset by compensation forces applied to the backing bar 2 in the opposite direction. Accordingly, rather than being translated to the position indicated by a dash-dot line in FIG. 1*b*, the backing bar is simply pivoted while applying compressive force to the book block. Restated, the rotational drive which tries to cause tangential movement of the backing bars in the direction of the book block edges is initially retarded or balanced by simultaneous rotational drive which tries to cause tangential displacement in the opposite direction through operation of the apparatus to be described below. Thus, during the operational sequence represented by the FIG. 1*a* to FIG. 1*b* progression, the printed sheets are subjected to compression alone as a result of the rolling movement of backing bar combined with the effect of the pressure that is applied to the book block back by the backing bar.

Figure 1B:
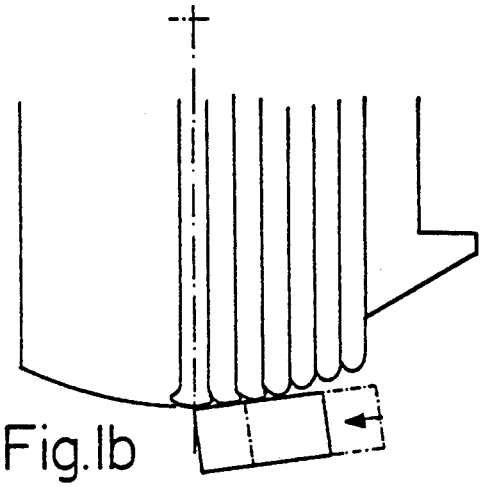
Figure 1C:
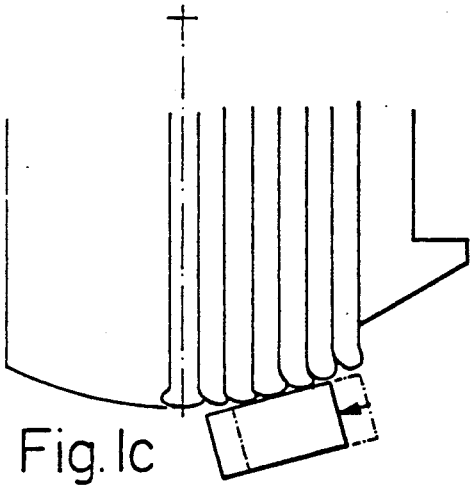
Figure 1D:
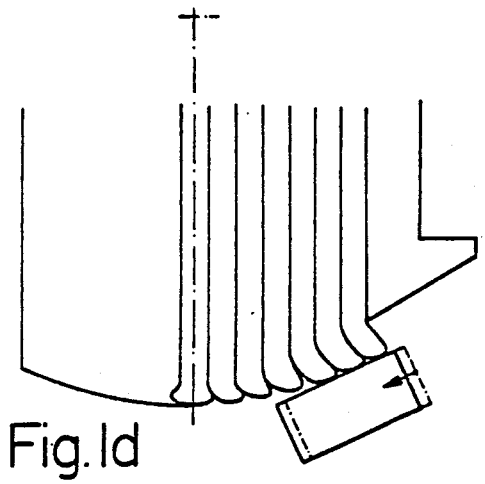
Figure 1E:
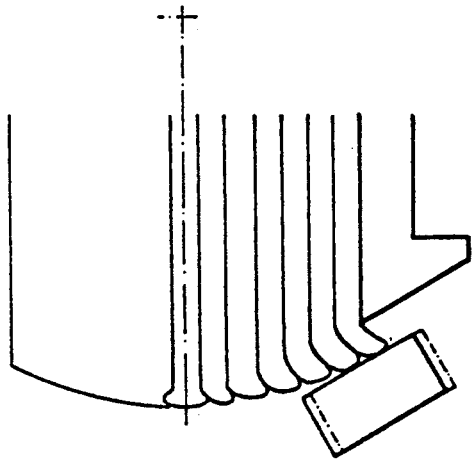

As the operational sequence continues, the backing bar 2 moves continuously from the position represented in FIG. 1*b* laterally through the positions represented in FIGS. 1*c* and 1*d* and arrives at its outermost lateral position as shown in FIG. 1*e*. This movement of the backing bar is tangential to the rounded book block back and is controlled in such a manner that the above-discussed compensating forces are decreased, this decrease in compensation typically being progressive. Accordingly, the printed sheets in the outer regions of the book block back are bent over by an increasingly powerful frictional, i.e., tensile, force component. In each of FIGS. 1*c*–1*e* the position of backing bar 2 represented by a dash-dot line is the position which the backing bar would have assumed if there were no compensation as a result of a rolling or rotational movement in a direction opposite to the tangential outward movement.

As will be described in more detail below, once the backing bars have reached the position depicted in FIG. 1*e*, they will be returned to the position represented in FIG. 1*a*. During this return motion, the backing bars will follow a path which keeps them spaced from the book block back.

In accordance with the preferred mode of practice of the invention, the backing bars 2 are in continuous movement. In the interest of treating the book block back gently, it has been found desirable to perform the operation represented by the FIGS. 1*a*–1*e* progression twice on each book block back. If the backing operation is repeated on a given block, the compressive force applied to the block by the backing bars, and thus the tensile forces generated, will typically be increased in stepwise fashion each time the backing operation is repeated.

The sliding, rubbing movement of the backing bars 2 can be varied in accordance with the desired shape of the book block back. This variation is accomplished through varying the compensating movement, in order to vary the applied frictional forces, and by directing the tangential movement to any desired areas of the book block back.

Figure 2:
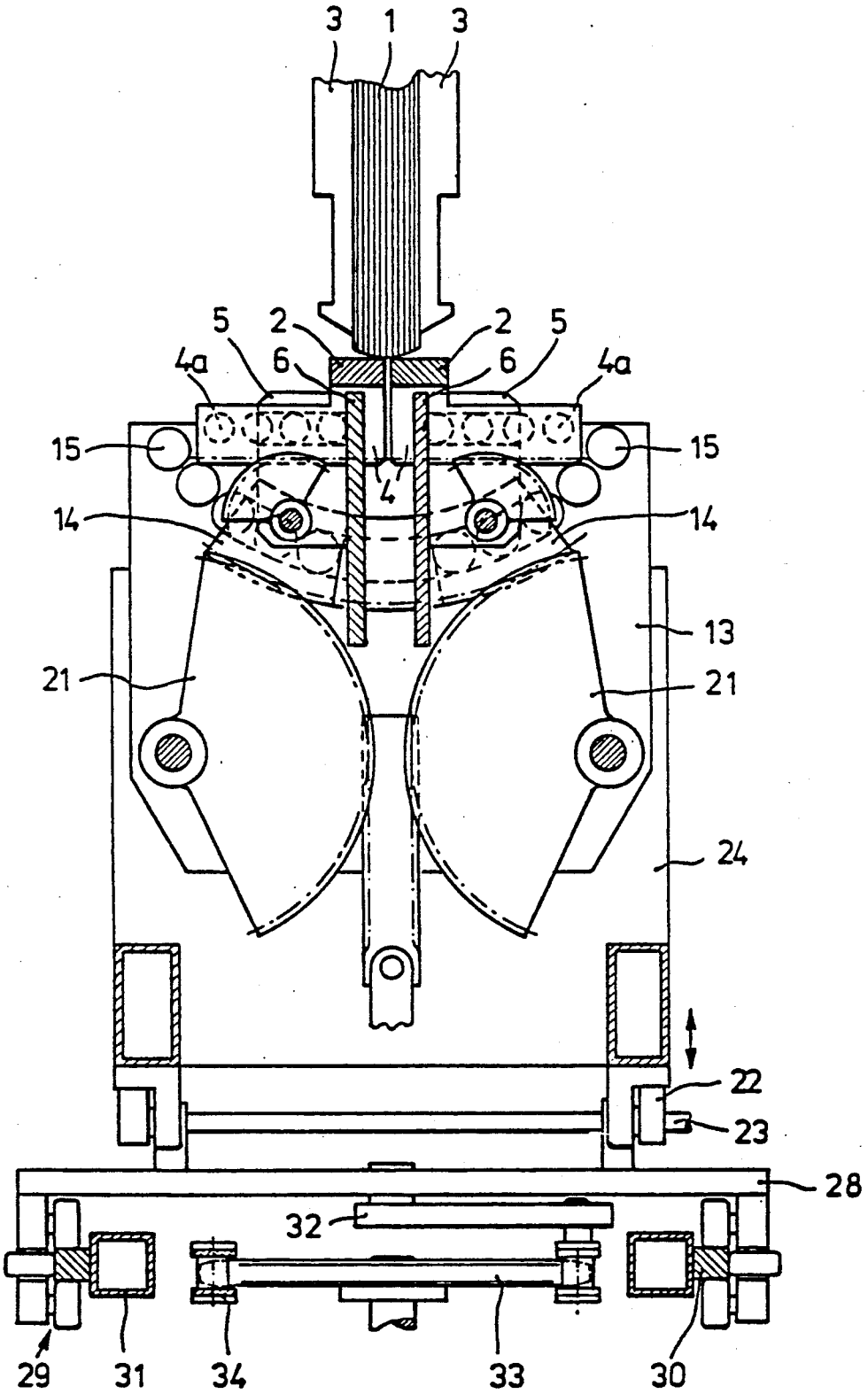
FIG. 2 is a cross-sectional view, taken along line A-B of FIG. 4, depicting apparatus in accordance with the disclosed embodiment of the invention, FIG. 2 showing the apparatus with the backing bars in the starting position.
Figure 3:
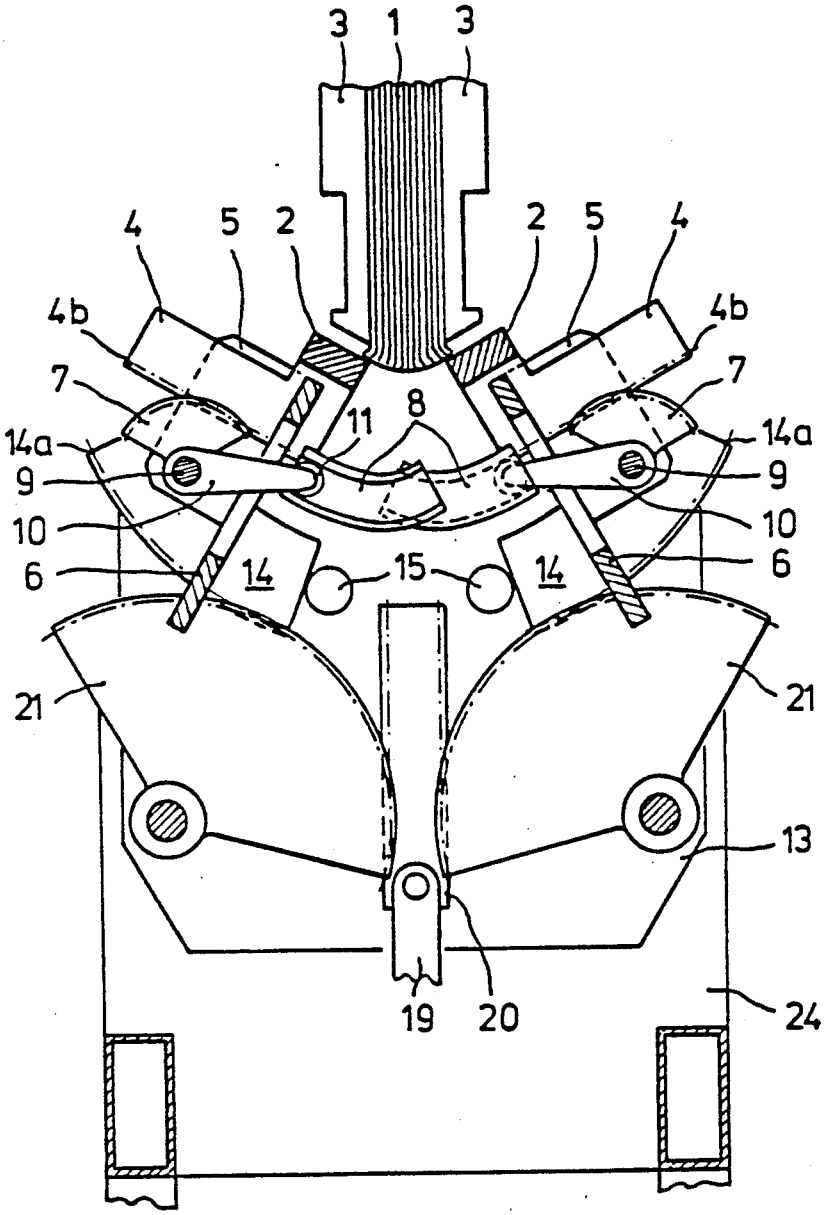
FIG. 3 is a view similar to FIG. 2, taken along line C-D of FIG. 4, with the backing bars being shown at their limits of lateral outward travel.
Figure 4:
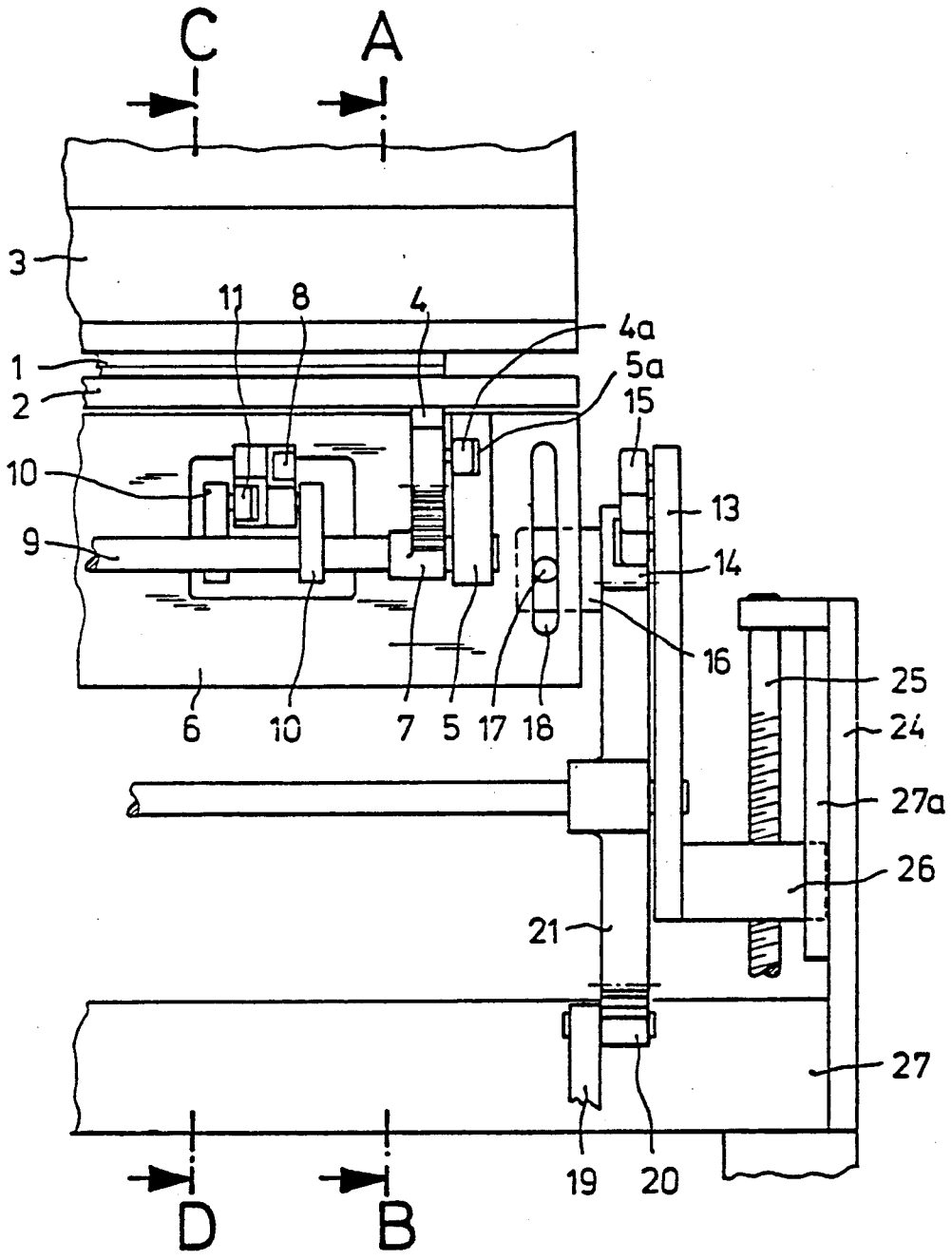
FIG. 4 is a side view of the right-hand portion of the apparatus of FIGS. 2 and 3.

With reference now to FIGS. 2–4, backing apparatus in accordance with a first embodiment of the invention is shown. The manner in which the movements of the backing bars 2 are produced, namely the tangential sliding, rubbing movement and the tangential compensating movement, will become apparent from the following description.

During a backing procedure, the two backing elements, i.e., the bars 2, simultaneously and continuously move in opposite directions. Each of the bars 2 is provided with a transversely extending arm 4. The arms 4 each support plural rollers **4*a* which cooperate to define linear roller paths. As may best be seen from FIG. 4, the rollers 4*a* engage tracks or guideways 5*a* provided in bearing members 5. The bearing members 5 are mounted on supporting frames 6**.

Each of the arms 4 of a backing bar 2 is provided with a toothed portion **4*b* which defines a rack. The racks 4*b* are engaged by respective toothed quadrants 7. The quadrants 7 associated with each backing bar are mounted on a rotatable driveshaft 9 which extends between bearing members 5 as shown in FIG. 4**.

Rotational motion is imparted to each driveshaft 9, and thus to the quadrants 7, via control levers 10. First ends of the control levers 10 are keyed or otherwise seated on the driveshafts 9 and, at their opposite ends, the control levers are provided with follower rollers 11. The follower rollers 11 engage cams 8 which are supported from frames 6. Movement of the follower rollers relative to their associated cams will cause the backing bars 2 to move in the linear guideways **5*a* in the bearing elements 5, the nature of this movement being determined by the shape of cams 8. As should become more apparent from the discussion below, the cams 8 generate the compensatory rolling movement of the backing elements 2 which is superimposed on the tangential sliding, rubbing movement thereof. The cams 8** may be replaced with cams of different shape to vary the forces exerted on the printed sheets comprising the book block as a function of distance from the center of the block.

The tangential sliding, rubbing movement of the backing bars 2 on the rounded back of the book block 1 originates from curved roller paths 15. The rollers which define the roller paths 15 are supported from side panels 13 which, as best seen from FIG. 4, are oriented transversely relative to support frames 6. The rollers 15 are engaged by guideway segments 14 which are extensions of adjustable coupling members 16. The guideway segments are connected, in the manner to be described below, to the support frames 6 via the adjustable coupling members 16. The guideway segments 14 are provided, on their undersides, with gear teeth **14*a***.

Continuing with the above description, and limiting the discussion to the right-hand portion of the backing apparatus as depicted in FIG. 4, one end of each coupling member 16 is integrated with a guideway segment 14. The other end of each coupling member 16 is releasably fastened to a support frame 6 by means of a clamping screw 17 which passes through an elongated hole 18 in the support frame 6. The support frames 6, and thus the backing bars 2 with their projecting arms 4, roller paths **4*a*, guideways 5*a* and bearing members 5, are caused to swing about an arc, defined by roller paths 15, between the position shown in FIG. 2 and that shown in FIG. 3. This swinging movement is produced by a cam-controlled, adjustable-stroke link mechanism 19 and is transmitted, via a rack 20, to toothed quadrants 21 which mesh with the gear teeth 14*a* on the guideway segments 14**.

The straight-line movement of the backing bars 2 in the guideways of bearing members 5 occurs in synchronism with the arcuate movement of the support frames 6 on which the bearing members 5 are mounted. The tangential sliding movement of the backing bars on the back of the book block 1 is controlled, i.e., the applied tensile forces are adjusted, by producing linear movement of the backing bars 2 relative to the bearing members 5 in a direction which is generally opposite to the backing bar movement commanded by the driving of support frames 6 along the roller paths 15. Thus, again considering only the right-hand portion of the apparatus as depicted in FIG. 4, during a backing operation the quadrant 21 will rotate in the clockwise direction as the backing bars proceed from the position of FIG. 2 to that of FIG. 3 while the quadrants 7 will rotate in the counterclockwise direction. The respective clockwise and counterclockwise rotation of quadrants 21 and 7 produces the outward motion of backing bars along a curved path with the simultaneous rotation thereof as shown in FIG. 1.

After the book block back has been subjected to the above-described backing operation, the two backing bars 2 are moved downwardly and then returned towards the center of the block along a path which is clear of the block back. The backing bars 2 are then again raised to their starting position which is shown in FIG. 2. As may be seen from FIG. 2, in order to cause this return movement, the entire backing apparatus is moved up and down, in the direction indicated by arrows, in synchronism with the swinging movement of the backing bars 2. This up and down movement of the backing apparatus originates from a driveshaft 23 and is transmitted to members 24 of the backing apparatus movable frame via eccentric cams 22. The cams 22 can be configured to cause the longitudinal force exerted on the book block to increase during the second pass of the backing bars over the block back.

The above-described backing operation is preferably performed on the book block back twice in the interest of treating the book block 1 gently. Once the backing bars have executed their first full progression (FIGS. **1*a*–FIGS. 1*e*), the entire backing apparatus moves downwardly, the quadrants 21 are returned to their initial position and the entire backing apparatus then executes a vertical infeeding movement as result of the eccentrics 22 being shifted. The backing bars 2** then execute their second swinging movement and, as noted above, the compressive force applied to the book block may be varied between the first and second cycles. Performing the backing operation twice has the further advantage in that the stabilization of the book block back is improved when compared to prior art backing operations.

By releasing the clamping screws 17, the side panels 13, with the toothed quadrants 21 and the guideway segments 14 with associated roller paths 15, can be repositioned in the vertical direction relative to the support frames 6. This repositioning enables the backing bars 2 to be adjusted to suit different book block back radii, i.e., the radius on which the backing bars 2 execute their swinging movement may be altered. An adjusting spindle 25 is provided in order to accomplish this repositioning through the agency of known actuating means, not shown. The adjusting spindle 25 engages a threaded block 26 which is fastened to the side member 24 which extends from the base frame 27 of the backing apparatus. The threaded block 26 is movable along a guideway 27*a* which is provided on side member 24.

The above-described book block backing apparatus can be caused to execute a reciprocating movement in synchronism with a continuously driven transport system which includes the clamps 3. The provision for such reciprocal motion of the backing apparatus enables a further increase in the throughput of the backing apparatus to be achieved. In order to execute this reciprocating movement over a defined travel distance, referring to FIG. 2, the entire backing apparatus may be carried by a base plate 28 which is provided with vertical and horizontal running rollers 29 which travel on tracks 30 associated with a machine frame 31. The base plate 28 is subject to the action of a propelling lever 32. Lever 32 is coupled to a chain 34 which is driven from a main drive and runs around reversing sprockets 33. As the chain 34 circulates, the propelling lever 35 causes the base plate 28, together with the book block backing apparatus, to move backwards and forwards along the book block motion path defined by the conveyor system.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. A method for the shaping of a book block so that a cover with a fold joint may be applied thereto, the book block comprising plural printed sheets and having previously been rounded to define an elongated book block back having a generally convex shape which extends between a pair of oppositely facing sides, said method comprising the steps of:

bringing a pair of backing elements into contact with the book block back at a starting position to execute a compressive force against the book block in the central region of the back thereof, the backing elements being closely spaced and parallelly oriented when brought into contact with the book block back at said starting position;

causing the individual backing elements of said pair to simultaneously execute rolling movements on the book block back respectively in clockwise and counterclockwise directions starting from said starting position at the central region of the book block back so as to compress the printed sheets comprising the block in the said central region;

causing the backing elements to simultaneously execute tangential sliding movements in opposite directions along the convex book block back outwardly from the central region thereof toward respective of the oppositely facing block sides while said backing elements are executing said rolling movements to thereby cause the printed sheets comprising the book block to be bent over in the side regions of the book block, the bending being in directions which are generally away from the book block center and occurring only in unclamped regions of the book block adjacent the back; and returning the backing elements to said starting position along a path which is clear of the book block back.

2. The method of claim 1 wherein compensating movements in a direction generally opposite to the tangential sliding movements are superimposed on the sliding movements whereby the tensile forces applied tot he printed sheets are controllably varied as the backing elements move away from the center of the book block back.

3. The method of claim 2 wherein the compensating movements are rolling movements which are opposite to a said tangential movement.

4. The method of claim 1 wherein the steps of causing the backing elements to move while contacting the book block are performed at least twice on each book block back.

5. The method of claim 4 wherein the compressive force applied to the book block back by the backing elements during a second tangential sliding movement is different from that applied during the first tangential sliding movement.

6. The method of claim 3 wherein the steps of causing the backing elements to move while contacting the book block are performed at least twice on each book block back.

7. The method of claim 6 wherein the compressive force applied to the book block back by the backing elements during a second tangential sliding movement is different from that applied during the first tangential sliding movement.

8. The method of claim 2 wherein the backing elements are continuously moved while in contact with the book block and wherein the superimposed compensating movement is progressively decreased during such continuous motion.

9. The method of claim 1 wherein the combined effect of said rolling and tangential sliding movements is to cause the frictional forces associated with the sliding movement to increase as the backing elements move outwardly away from the book block central region.

10. Apparatus for shaping a book block back in order to accommodate a cover to be applied thereto, the book block having previously been subjected to a rounding procedure whereby a convex shape was imparted to the back thereof, said apparatus comprising:

shaping means including a pair of parallelly oriented backing elements;

means for movably supporting each of said shaping means, said supporting means defining linear motion paths for said shaping means;

means for imparting arcuate motion to said supporting means whereby said supporting means and their associated backing elements can be caused to execute swinging movements in opposite directions on a preselected radius;

means responsive to said arcuate motion for causing relative linear motion along said linear motion paths between said shaping means and respective of said supporting means whereby arcuate motion of a supporting means in a first direction will cause linear movement of an associated shaping means relative to a said supporting means in a second direction, said motion in the second direction at least partly offsetting said motion in the first direction; and means for moving said arcuate motion imparting means to a first position where said backing elements apply a compressive force to a book block in the central region thereof, said first position corresponding to a first limit of travel of said supporting means during the swinging movement thereof, said moving means returning said arcuate motion imparting means to said first position along a path which does not establish contact between the backing elements and a book block after said supporting means have executed swinging motion to a second limit of travel.

11. The apparatus of claim 10 wherein said supporting means each comprise:

a support frame;

bearing members mounted on said support frame, said bearing members supporting said shaping means and at least in part defining said linear motion paths; and drive means rotatably supported from said bearing members and coupled to said shaping means whereby arcuate motion of said support frame will cause linear motion of said shaping means; and wherein said backing elements each comprise:

a backing bar; and arm means extending from said backing bar, said arm means being engaged by said drive means, said arm means being coupled to said bearing members such that said arm means can move relative to said bearing members along said linear paths in response to rotation of said drive means.

12. The apparatus of claim 10 wherein said arcuate motion imparting means each comprise:

guide means, said guide means defining an arcuate motion path;

means coupling said guide means to one of said supporting means, said coupling means being movable relative to said guide means along said arcuate motion path; and means for imparting motion to said coupling means.

13. The apparatus of claim 11 wherein said arcuate motion imparting means comprises:

guide means, said guide means defining an arcuate motion path;

means coupling said guide means to one of said support frames, said coupling means being movable relative to said guide means along said arcuate motion path; and means for imparting motion to said coupling means.

14. The apparatus of claim 10 further comprising:

means for adjusting the distance between said backing elements and said arcuate motion imparting means.

15. The apparatus of claim 13 further comprising:

means for adjusting the distance between said support frames elements and said curved guide means.

16. The apparatus of claim 10 further comprising:

translation means for moving said apparatus toward and away from a book block to be shaped in synchronism with the movement of backing bars.

17. The apparatus of claim 16 wherein said shaping means can be adjusted so as to reposition them relative to a book block, said repositioning being accomplished by means of said translating means.

18. The apparatus of claim 10 wherein the book blocks to be shaped travel on a continuously moving conveyor and are held in clamping devices, said apparatus further comprising:

frame means, said moving means being mounted on said frame means; and a propelling arrangement which causes said frame means to execute a reciprocating movement in synchronism with a continuously moving clamping device which holds the book blocks to be shaped.

19. The apparatus of claim 10 wherein said means responsive to arcuate motion for producing linear motion comprises:

cam means;

cam follower means, said follower means engaging said cam means; and lever means coupling said follower means to said shaping means.

20. The apparatus of claim 13 wherein said drive means comprises first rotatable gear means, said means for imparting motion to said coupling means comprises second rotatable gear means, rotation of said second gear means in a first direction causing rotation of said first gear means in the opposite direction, and where said means responsive to arcuate motion for causing linear motion comprises:

lever means coupled to said first gear means;

cam follower means on said lever means; and cam means engaged by said follower means, said support frames being movable relative to said cam means.

* * * * *